US008179052B2

(12) United States Patent
Tiso

(10) Patent No.: US 8,179,052 B2
(45) Date of Patent: May 15, 2012

(54) REDUCED POWER LOSS IN ELECTRONIC BALLASTS

(75) Inventor: Michele Tiso, Glonn (DE)

(73) Assignee: OSRAM AG, Munich (DE)

( * ) Notice: Subject to any disclaimer, the term of this patent is extended or adjusted under 35 U.S.C. 154(b) by 764 days.

(21) Appl. No.: 12/226,279

(22) PCT Filed: Apr. 5, 2007

(86) PCT No.: PCT/EP2007/053367

§ 371 (c)(1),
(2), (4) Date: Dec. 4, 2008

(87) PCT Pub. No.: WO2007/116016

PCT Pub. Date: Oct. 18, 2007

(65) Prior Publication Data

US 2009/0134811 A1 May 28, 2009

(30) Foreign Application Priority Data

Apr. 11, 2006 (DE) ..... 10 2006 017 341

(51) Int. Cl.
*H05B 37/02* (2006.01)

(52) U.S. Cl. ..... 315/219; 315/278; 315/291; 315/307

(58) Field of Classification Search ..... 315/246–247, 315/224–225, 276, 274, 278, 291, 307–311
See application file for complete search history.

(56) References Cited

U.S. PATENT DOCUMENTS

| | | | | |
|---|---|---|---|---|
| 4,066,930 | A * | 1/1978 | Summa | 315/209 R |
| 4,987,324 | A * | 1/1991 | Wong et al. | 326/27 |
| 4,999,547 | A * | 3/1991 | Ottenstein | 315/307 |
| 7,030,569 | B2 * | 4/2006 | Gray | 315/224 |
| RE42,334 | E * | 5/2011 | Miyagi | 320/133 |
| 2004/0080283 | A1 | 4/2004 | Mayer et al. | |

FOREIGN PATENT DOCUMENTS

| | | | |
|---|---|---|---|
| GB | 2 068 656 | A | 8/1981 |
| JP | 7272882 | A | 10/1995 |
| JP | 2005229800 | A | 8/2005 |

OTHER PUBLICATIONS

English language abstract for JP 7-272882 A.
English language abstract for JP 2005-229800 A.
International Search Report dated Jul. 18, 2007, in PCT application.

* cited by examiner

*Primary Examiner* — James H Cho

(57) ABSTRACT

An electronic ballast is disclosed, in particular for operation of gas-discharge lamps, in which a further power semiconductor is provided in addition to the conventional power semiconductor, and provides the power required for steady-state operation. This avoids the high-power MOSFET transistors, whose power losses are high, also being used for steady-state operation.

14 Claims, 2 Drawing Sheets

REDUCED POWER LOSS IN ELECTRONIC BALLASTS

TECHNICAL FIELD

The present invention relates to an electronic ballast having a first power semiconductor, in particular a MOSFET, whose power is dimensioned with respect to a start-up power.

PRIOR ART

Electronic ballasts are used, in particular, in lamps to ensure that a low-frequency mains voltage is first of all rectified and is then converted into a high-frequency square-wave voltage using a high-frequency alternating rectifier. As a result, the efficiency of the lamps is increased and a longer service life is achieved, for example.

Discharge lamps, in particular, such as fluorescent tubes or energy-saving lamps, must be operated with ballasts in order to limit the current. In this case, the lamp must be started with a high voltage, for which purpose the electronic ballast must provide a high so-called start-up power. Depending on the type of lamp, this start-up power may be a few hundred volts to several kV. During steady-state operation—that is to say after the gas discharge has been started—the current can be reduced again since a low voltage is sufficient for operating the discharge lamp.

A power semiconductor whose dimensions must be matched to the required start-up power is responsible for providing the voltage in the ballast. Therefore, use is usually made of powerful MOSFET transistors which, however, have a high power loss when the lamp changes to steady-state operation.

SUMMARY OF THE INVENTION

Therefore, the object of the present invention is to provide an electronic ballast whose efficiency is improved in comparison with conventional solutions.

This object is achieved by means of an electronic ballast having a first power semiconductor, in particular a MOSFET, whose power is dimensioned with respect to a start-up power, the electronic ballast comprising at least one second power semiconductor.

This makes it possible to use both power semiconductors in the start-up phase—that is to say during starting, which makes it possible to provide a very high start-up power, whereas the first power semiconductor is deactivated during steady-state operation and only the second power semiconductor provides the steady-state power. This allows the use of power semiconductors with smaller dimensions, thus resulting in distinct power savings, which in turn improves the overall efficiency of the system.

In addition, the use of power semiconductors with smaller dimensions eliminates the problem of the very high driver powers, which would be required when using only one power semiconductor, negating the advantage of the high switching frequencies since they impair efficiency. However, special power semiconductors which are highly suitable for very high frequencies are very expensive, which in turn has an adverse effect on the production costs. In addition, smaller power semiconductors have the advantage that the physical size of the housings in which they are fitted can be smaller.

One exemplary embodiment in which the power semiconductors have different dimensions is particularly advantageous. In particular, it is advantageous to use a second power semiconductor whose power is considerably lower than the power of the first power semiconductor for steady-state operation.

If it is assumed that only approximately ⅓ of the start-up power is required during steady-state operation, the power of the second power semiconductor can also be only ⅓ of the power of the first power semiconductor, for example.

Another preferred exemplary embodiment provides a control unit which controls the activation and deactivation of the power semiconductors. In addition, if the power semiconductors are arranged in a parallel manner with respect to one another, the driving operation may involve driving a switch, for example an interrupter contact, which deactivates the first power semiconductor, with the result that only the second power semiconductor provides the power.

Further advantages and preferred embodiments are defined in the subclaims.

BRIEF DESCRIPTION OF THE DRAWINGS

The invention is explained in more detail below using drawings. However, the exemplary drawings are not intended to be used in this case to restrict the present invention to the exemplary embodiments illustrated.

In the drawings.

PREFERRED EMBODIMENT OF THE INVENTION

Figure 1:
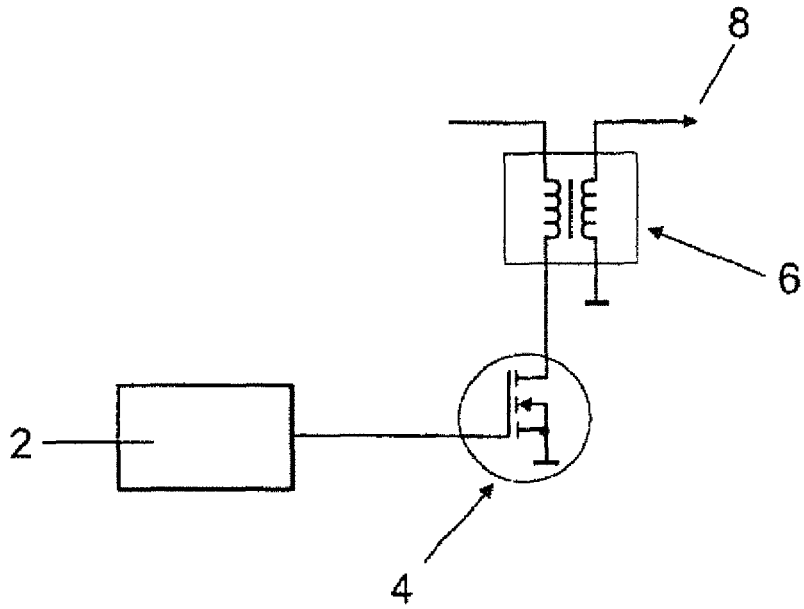
FIG 1 PRIOR ART
FIG. 1: shows a schematic partial view of a circuit diagram of an electronic ballast from the prior art.
Figure 2A:
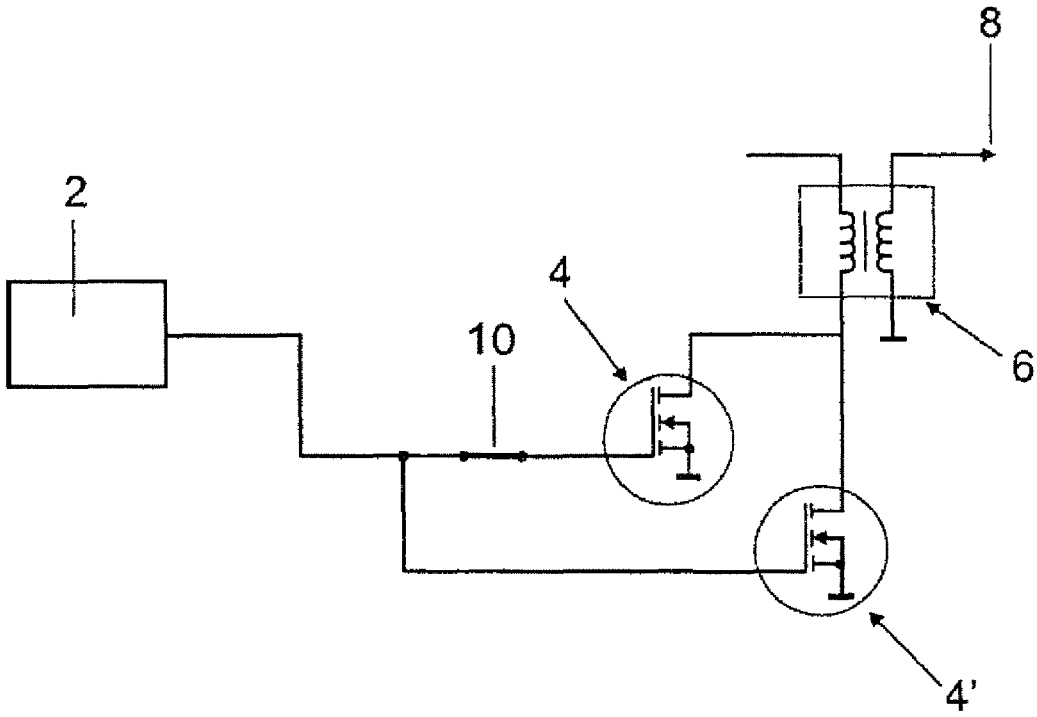
FIG. 2*a*: shows a schematic partial view of a circuit diagram of a first exemplary embodiment of the electronic ballast according to the invention in a start-up phase.
Figure 2B:
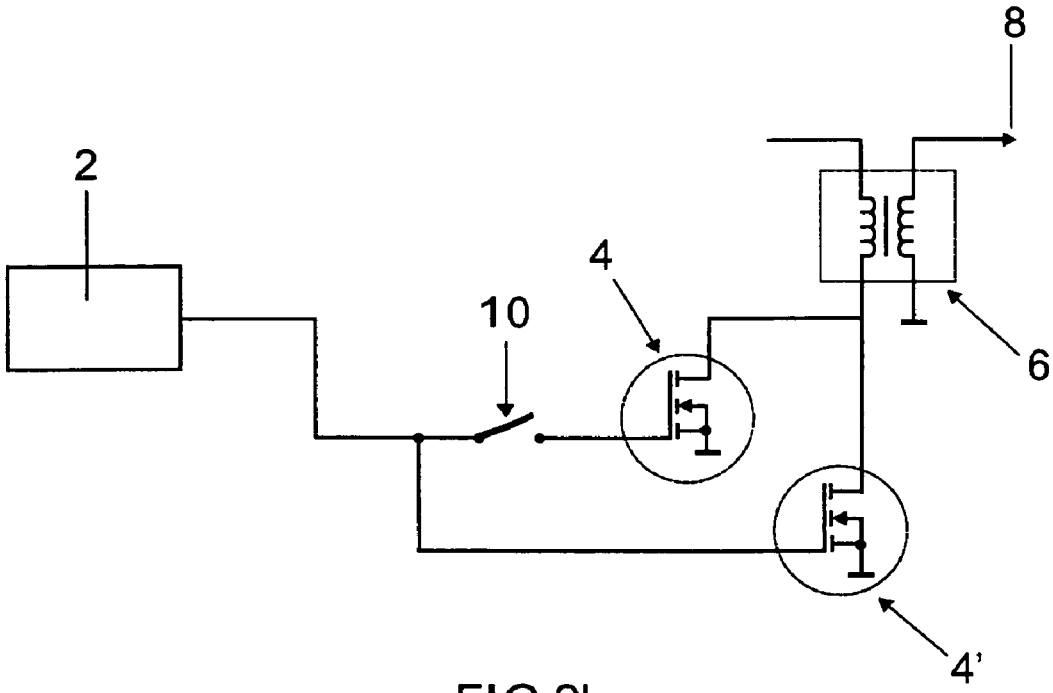
FIG. 2*b*: shows a schematic partial view of a circuit diagram of the exemplary embodiment of the electronic ballast according to the invention, which is shown in FIG. 2*a*, during steady-state operation.
Figure 3:
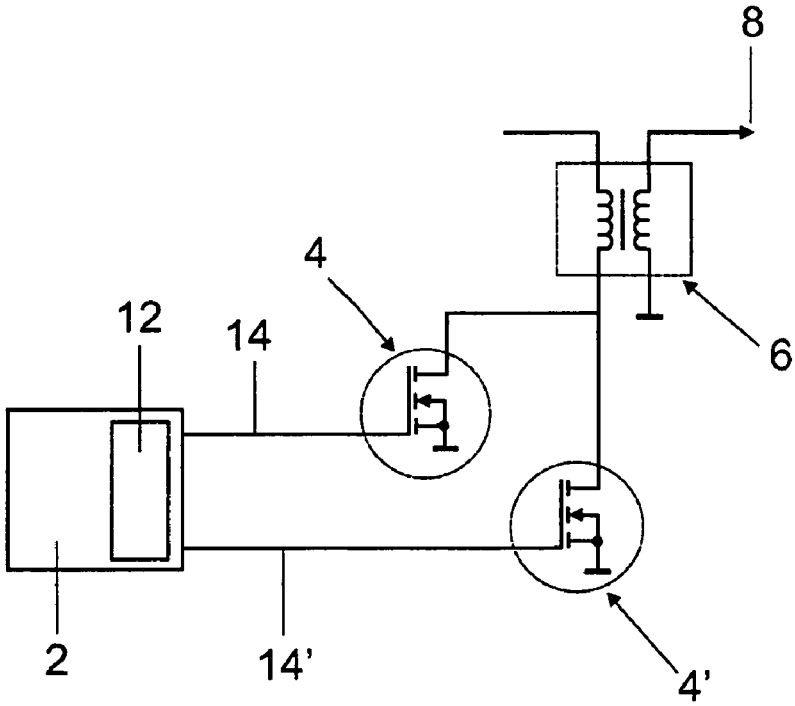
FIG. 3: shows a schematic partial view of a circuit diagram of a second exemplary embodiment of the electronic ballast according to the invention.

FIGS. 1 to 3 show only the components of the electronic ballast which are relevant to the invention. In this case, the same reference symbols denote identical or analogous components.

FIG. 1 shows a partial view of a circuit diagram of a conventional electronic ballast and shows, as selected parts of the electronic ballast, a driver 2 which outputs a square-wave control signal, a power semiconductor 4 which is designed to output the power needed for the starting operation of a lamp (not illustrated here), a transformer 6 which is intended to control the voltage supplied to the lamp and has an output 8 which can be connected to such a lamp, for example.

The power semiconductor 4 used in the prior art must provide the voltage needed to start gas discharge lamps. Powerful power semiconductors, for example powerful MOSFETs, are needed for this purpose on account of the high voltage requirement. Although such MOSFETs can provide the power needed to start a gas discharge lamp without any problems, they also consume a lot of power during steady-state operation of the lamp—that is to say after the starting operation, thus resulting in a high power loss. This in turn results in poorer efficiency of the electronic ballast. In addition, the MOSFETs used here are relatively large, with the result that component-dictated limits are imposed on desired miniaturization of the electronic ballast.

Therefore, the present invention proposes using two small power semiconductors, which can together provide the high power for starting, but only one power semiconductor during steady-state operation.

Such an electronic ballast according to the invention is illustrated in FIGS. 2*a* and 2*b*. In this case, FIG. 2*a* shows the circuit of the electronic ballast in the starting state and FIG. 2*b* shows the circuit of the electronic ballast during steady-state operation.

In the exemplary embodiment shown here, a first power semiconductor 4 and a second power semiconductor 4', which are connected in parallel, are used according to the invention. Provision is also made of a switching element 10 which is suitable for activating and deactivating the power semiconductor 4.

FIG. 2*a* shows the start-up phase of an electronic ballast, that is to say the state in which a high voltage must be available in order to start a gas discharge lamp, for example. For this purpose, the switch 10 is in a closed position, as a result of which both power semiconductors 4, 4' are connected in parallel, thus supplementing their powers.

If the gas discharge lamp changes to its steady-state operation, the first power semiconductor 4 can be deactivated. As shown in FIG. 2*b* the switch 10 is opened for this purpose, with the result that power is only supplied using the second power semiconductor 4'. Since the second power semiconductor 4' must alone provide only a lower power, it can also be optimized with respect to this lower power. The power loss of the electronic ballast is considerably reduced as a result.

One exemplary embodiment in which the power of the second power semiconductor 4' is additionally even lower than the power of the first power semiconductor 4 is particularly advantageous. This is possible since often only ⅓ of the power needed for the starting operation has to be provided during steady-state operation. This is schematically indicated in FIGS. 2*a* and 2*b* by virtue of the fact that the second power semiconductor 4' is illustrated on a smaller scale than the first power semiconductor 4. This results in yet another power saving.

In addition, only a small power semiconductor needs to be operated for switching operations, which consumes considerably less power, thus making it possible to improve the overall efficiency of the system.

FIG. 3 shows the partial view of a circuit diagram of a second exemplary embodiment of the electronic ballast according to the invention. This differs from the exemplary embodiment shown in FIGS. 2*a* and 2*b* by virtue of the fact that the switch 10 is integrated in the driver 2. This may be achieved, for example, by means of a control unit 12 which either makes both lines 14 and 14' available, with the result that the first and second power semiconductors 4, 4' can provide power, or blocks the line 14, with the result that the power semiconductor 4 is deactivated.

The invention discloses an electronic ballast, in particular for the operation of gas discharge lamps, in which, in addition to the power semiconductor which is conventionally present, there is a further power semiconductor which provides the power needed for steady-state operation.

The invention claimed is:

1. An electronic ballast having a first power semiconductor whose power is dimensioned with respect to a start-up power, wherein the electronic ballast comprises at least one second power semiconductor, the ballast changing to steady-state operation with a steady-state power after the starting operation with the start-up power, and the power for steady-state operation being provided by the second power semiconductor.

2. The electronic ballast as claimed in claim 1, the second power semiconductor having a power which is different from that of the first power semiconductor.

3. The electronic ballast as claimed in claim 2, the second power semiconductor having a lower power than the first power semiconductor.

4. The electronic ballast as claimed in claim 2, the first and second power semiconductors being arranged in a parallel manner.

5. The electronic ballast as claimed in claim 2, provision also being made of a control unit which drives the first and second power semiconductors.

6. The electronic ballast as claimed in claim 2, the control unit driving the first and second power semiconductors in such a manner that the first and second power semiconductors are connected in parallel in order to provide the start-up power, as a result of which the start-up power is provided by both power semiconductors.

7. The electronic ballast as claimed in claim 2, the ballast changing to steady-state operation with a steady-state power after the starting operation with the start-up power, and the power for steady-state operation being provided by the second power semiconductor.

8. The electronic ballast as claimed in claim 2, provision also being made of a switching element which is designed to deactivate the first power semiconductor.

9. The electronic ballast as claimed in claim 1, the second power semiconductor having a lower power than the first power semiconductor.

10. The electronic ballast as claimed in claim 9, the first and second power semiconductors being arranged in a parallel manner.

11. The electronic ballast as claimed in claim 1, the first and second power semiconductors being arranged in a parallel manner.

12. The electronic ballast as claimed in claim 1, provision also being made of a control unit which drives the first and second power semiconductors.

13. The electronic ballast as claimed in claim 1, the control unit driving the first and second power semiconductors in such a manner that the first and second power semiconductors are connected in parallel in order to provide the start-up power, as a result of which the start-up power is provided by both power semiconductors.

14. The electronic ballast as claimed in claim 1, the control unit driving the first and/or second power semiconductor in such a manner that the steady-state power is provided by the second power semiconductor.

* * * * *